US009660366B2

(12) United States Patent
Andriamiharivolamena et al.

(10) Patent No.: US 9,660,366 B2
(45) Date of Patent: May 23, 2017

(54) DEVICE FOR CONNECTING A RADIOFREQUENCY CIRCUIT OR COMPONENT PRINTED ON A FLEXIBLE SUPPORT TO A COAXIAL CABLE

(71) Applicants: Safran Electronics & Defense, Boulogne-Billancourt (FR); INSTITUT POLYTECHNIQUE DE GRENOBLE, Grenoble (FR)

(72) Inventors: Tsitoha Andriamiharivolamena, Boulogne-Billancourt (FR); Franck Tirard, Boulogne-Billancourt (FR); Smail Tedjini, Grenoble (FR); Pierre Lemaitre-Auger, Grenoble (FR)

(73) Assignees: SAFRAN ELECTRONICS & DEFENSE, Boulogne-Billancourt (FR); INSTITUT POLYTECHNIQUE DE GRENOBLE, Grenoble (FR)

( * ) Notice: Subject to any disclaimer, the term of this patent is extended or adjusted under 35 U.S.C. 154(b) by 0 days.

(21) Appl. No.: 15/311,165

(22) PCT Filed: May 15, 2015

(86) PCT No.: PCT/EP2015/060754
§ 371 (c)(1),
(2) Date: Nov. 14, 2016

(87) PCT Pub. No.: WO2015/173387
PCT Pub. Date: Nov. 19, 2015

(65) Prior Publication Data

US 2017/0077628 A1 Mar. 16, 2017

(30) Foreign Application Priority Data

May 15, 2014 (FR) ..... 14 54336

(51) Int. Cl.
*H01R 24/50* (2011.01)
*H01R 12/70* (2011.01)
(Continued)

(52) U.S. Cl.
CPC ..... *H01R 12/7064* (2013.01); *H01Q 1/38* (2013.01); *H01R 12/81* (2013.01); *H01R 24/50* (2013.01);
(Continued)

(58) Field of Classification Search
CPC ..... H01R 2103/00; H01R 24/50
(Continued)

(56) References Cited

U.S. PATENT DOCUMENTS 6,048,212 A * 4/2000 Stauble ..... H01P 1/047 439/63
6,126,453 A * 10/2000 Gomez ..... H01R 24/52 439/63
(Continued)

FOREIGN PATENT DOCUMENTS

EP 1760825 A1 3/2007
WO WO-2011103874 A1 9/2011

OTHER PUBLICATIONS

International Preliminary Report on Patentability, with English Language Translation, dated Jul. 28, 2016, PCT Application No. PCT/EP2015/060754.
(Continued)

*Primary Examiner* — Gary Paumen
(74) *Attorney, Agent, or Firm* — Blakely Sokoloff Taylor & Zafman LLP

(57) ABSTRACT

The invention concerns a device (4) for connecting a radio frequency circuit (3) or component printed on a flexible support (2) to a coaxial cable, comprising: —a first part (14) suitable for being disposed against a first face (5) of the
(Continued)

Figure 1:
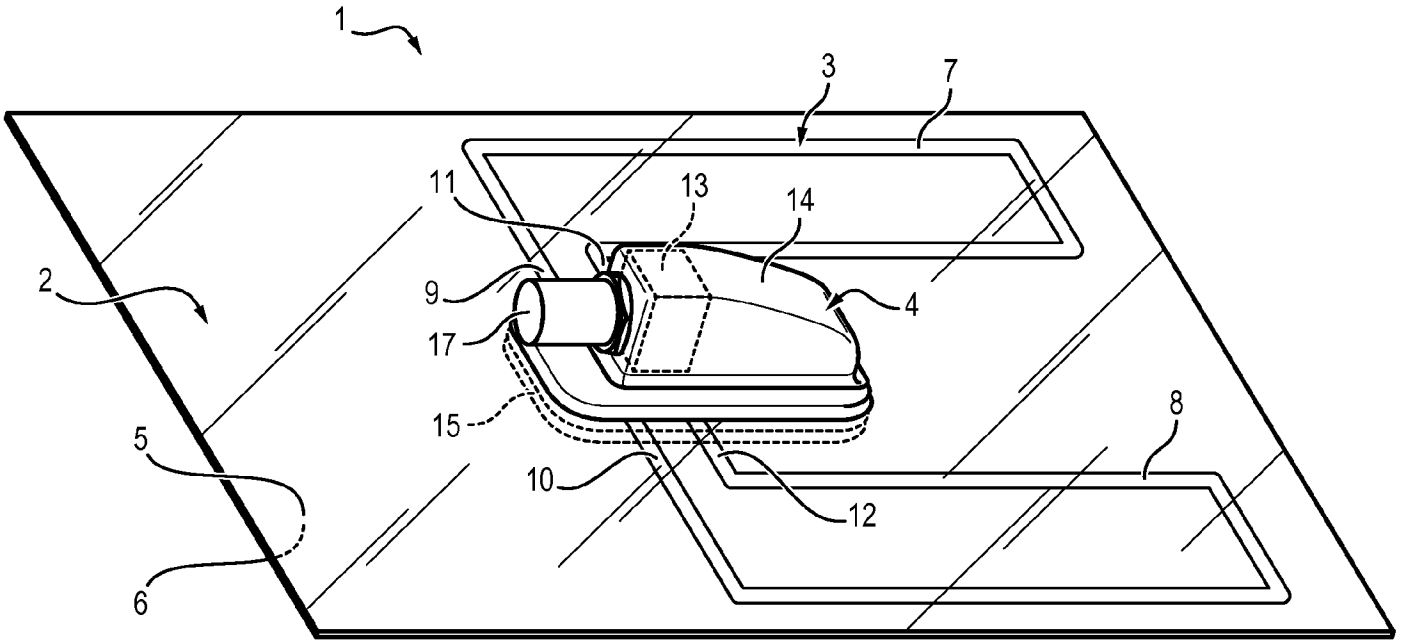

support (2) on which the circuit or the component (3) is printed, the first part (14) comprising a recess capable of housing a coaxial cable connector (13), —a second part (15) capable of being disposed against a second face (6) of the support (2), opposite the first face, and in which the first part (14) and/or the second part (15) comprises attachment means for attaching the first part (14) and the second part (15) to each other, the flexible support (2) being clamped between the first part (14) and the second part (15), in such a way as to maintain an electrical contact between the connector (13) and the circuit or component (3).

15 Claims, 3 Drawing Sheets

(51) Int. Cl.
*H01Q 1/38* (2006.01)
*H01R 12/81* (2011.01)
*H01R 103/00* (2006.01)

(52) U.S. Cl.
CPC ..... *H01R 2103/00* (2013.01); *H01R 2201/02* (2013.01)

(58) Field of Classification Search
USPC ..... 439/63, 581, 917
See application file for complete search history.

(56) References Cited

U.S. PATENT DOCUMENTS

| | | | | |
|---|---|---|---|---|
| 6,431,915 | B1 * | 8/2002 | Ko | H01R 24/50 439/581 |
| 7,862,348 | B2 * | 1/2011 | Strauss | H01R 4/56 29/833 |
| 8,747,121 | B1 * | 6/2014 | Hoffmann | H04N 5/64 439/63 |
| 9,142,924 | B2 * | 9/2015 | Tarulli | H01R 24/50 |
| 9,236,655 | B2 * | 1/2016 | Silva | H01R 12/79 |
| 2007/0052601 | A1 * | 3/2007 | Onishi | H01Q 1/1271 343/713 |
| 2008/0176439 | A1 * | 7/2008 | Chen | H05K 1/182 439/345 |
| 2012/0315772 | A1 * | 12/2012 | Joschika | H01R 12/7011 439/55 |

OTHER PUBLICATIONS

International Search Report with English Language Translation, dated Jun. 29, 2015, PCT Application No. PCT/EP2015/060754.
French Search Report with English language Translation Cover Sheet, dated Jan. 9, 2015, FR Application No. 1454336.

* cited by examiner

DEVICE FOR CONNECTING A RADIOFREQUENCY CIRCUIT OR COMPONENT PRINTED ON A FLEXIBLE SUPPORT TO A COAXIAL CABLE

FIELD OF THE INVENTION

The invention relates to a connecting device of a radiofrequency circuit or component printed on a flexible support to a coaxial cable.

STATE OF THE ART

Foot soldiers are now equipped with protective clothing which incorporates electronic radio communication equipment. This electronic radio communication equipment generally comprises radiofrequency components, including especially a radiofrequency antenna of "whip antenna" type. But, these antennas can be bulky.

Also, for them to function effectively, these antennas must be positioned vertically. In this way, these antennas lose their efficacy as soon as the soldier is in a prone position.

It would be possible to replace these whip antennas by antennas integrated into the protective clothing, for example by printing the antenna and the power circuit of the antenna directly onto a part of the clothing, such as on a piece of fabric. That part of the clothing would thus serve as support for the antenna and the power circuit.

But, this solution would require designing of a specific mating connector to electrically connect the electronic communication equipment to the antenna printed on the support.

The design of such a connector is all the more complex since the support is a flexible support, whereas the connector is necessarily rigid. In this way, fixing the connector by adhesion or welding directly to the flexible support would risk causing tearing of the flexible support in the long term.

SUMMARY OF THE INVENTION

An aim of the invention is to propose a connecting device adapted for connecting a radiofrequency circuit or component printed on a flexible support to a coaxial cable.

This aim is achieved in terms of the present invention by way of a connecting device of a radiofrequency circuit or component printed on a flexible support to a coaxial cable, comprising:

a first piece suitable for being arranged against a first face of the support on which the circuit or the component is printed, the first piece comprising a cavity suitable for housing a coaxial cable connector, a first opening through which a connecting socket of the connector can extend to connect the coaxial cable and a second opening through which contact pads can extend to come into contact with tracks of the radiofrequency circuit, a second piece suitable for being arranged against a second face of the support, opposite the first face, and wherein the first piece and/or the second piece comprises fixing means for fixing the first piece and the second piece together, the flexible support being clamped between the first piece and the second piece, so as to maintain electrical contact between the connector and the printed radiofrequency circuit or component.

As the pieces are fixed to the flexible support by clamping, the proposed device connects the printed radiofrequency circuit or component to the coaxial cable without damaging the flexible support.

Also, the proposed device enables use of a standard connector, already qualified for the intended applications.

The device can further have the following characteristics:

the first piece has a first planar face arranged in contact with the first face of the support when the first piece is arranged against the first face of the support, the second piece has a second planar face arranged in contact with the second face of the support when the second piece is arranged against the second face of the support, the fixing means comprise fastening holes formed in one of the pieces and attachment pins formed in the other of the pieces and suitable for being inserted into the fastening holes to fix the first piece and the second piece together, the pins extend through the flexible support when the first piece and the second piece are fixed together, the flexible support being clamped between the first piece and the second piece, the device comprises a coaxial cable connector suitable for being housed in the cavity of the first piece, the cable connector comprises a connecting socket for a coaxial cable for connecting the coaxial cable in a connection direction substantially parallel to the first face of the support, the cable connector comprises a threaded surface for screwing the coaxial cable onto the connector, the connector comprises contact pads extending in a direction substantially perpendicular to the first face of the support and suitable for coming into contact with tracks of the printed radiofrequency circuit or component, the first piece comprises a substantially planar part suitable for coming into contact with the first face of the support and a bulging part enclosing the cavity and extending projecting from the planar part, the bulging part having a curved external surface.

PRESENTATION OF THE DRAWINGS

Figure 3:
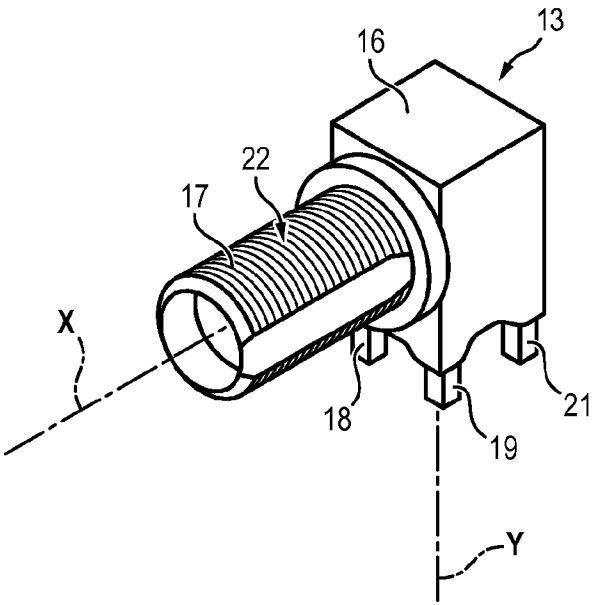
Figure 2:
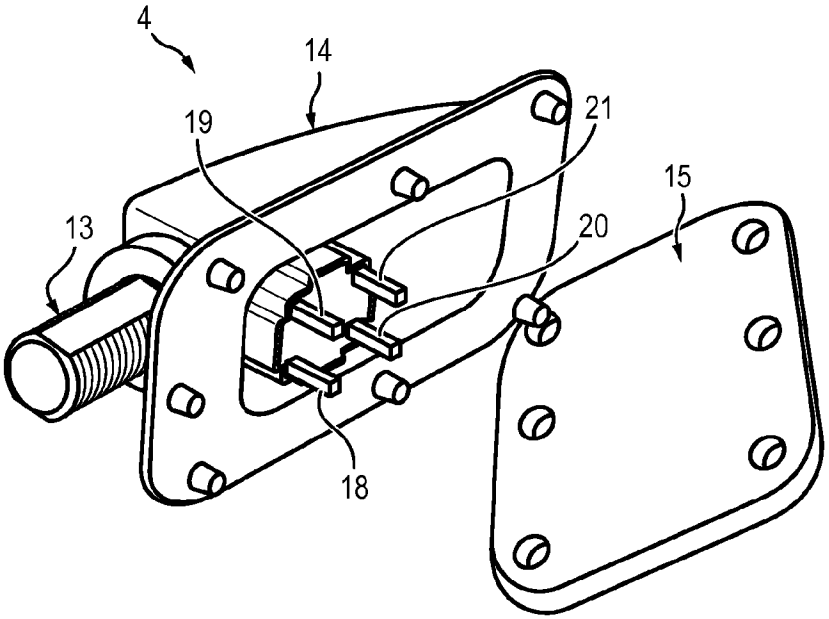
Figure 4D:
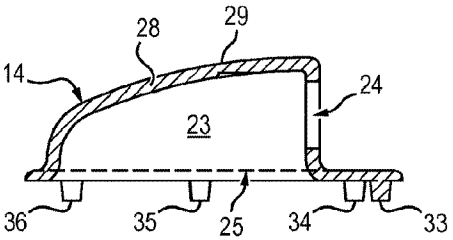
Figure 4B:
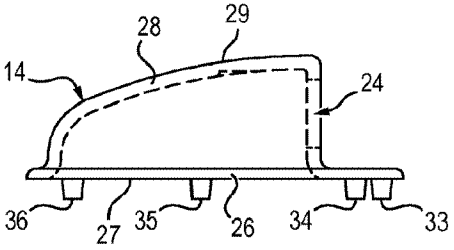
Figure 4A:
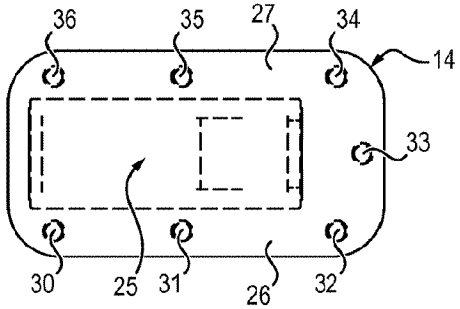
Figure 4C:
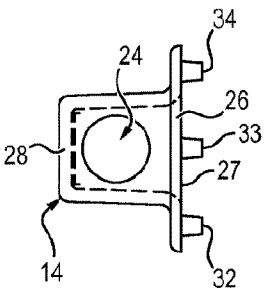
Figure 5B:
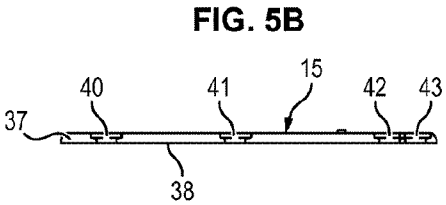
Figure 5A:
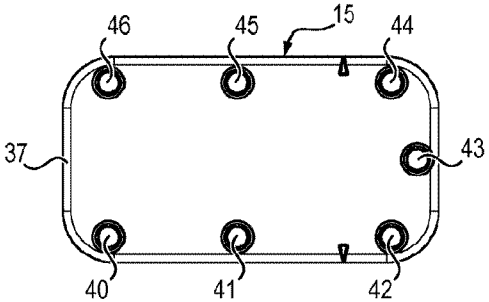
Figure 5C:
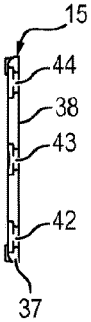

Other characteristics and advantages will emerge from the following description which is purely illustrative, and non-limiting, and must be considered relative to the appended figures, in which:

FIG. 1 schematically illustrates an antenna array comprising a printed circuit and a connecting device according to an embodiment of the invention, FIG. 2 schematically illustrates the different pieces of the connecting device, FIG. 3 schematically illustrates a coaxial cable connector of the connecting device, FIGS. 4A to 4D schematically illustrate a first piece of the connecting device, FIGS. 5A to 5C schematically illustrate a second piece of the connecting device.

DETAILED DESCRIPTION OF AN EMBODIMENT

In FIG. 1, the antenna array 1 shown comprises a support 2, an antenna circuit 3 printed on the support 2 and a connecting device 4 for electrically connecting the printed circuit 3 to a coaxial cable (not shown). The antenna circuit 3 can include a radiating part forming the antenna and a power supply part for powering the antenna.

The support 2 has the form of a planar, thin sheet, made of flexible material, such as fabric or a flexible plastic material (for example polyimide). The support 2 has a first face 5 and a second face 6, opposite the first face.

The circuit 3 comprises one or more conductive tracks printed on the first face 5 of the support. On the example shown in FIG. 1, the circuit 3 comprises two conductive tracks 7 and 8 printed on the support 2. Each conductive track 7, respectively 8, comprises a first end 9, respectively 10, and a second end 11, respectively 12.

The connecting device 4 comprises a coaxial cable connector 13, a first piece 14 (or interface piece) and a second piece 15 (or counter-piece).

When the device 4 is mounted on the support 2, the first piece 14 is in contact with the first face 5 of the support 2 and the second piece 15 is in contact with the second face 6 of the support 2. The support 2 is interposed between the two pieces 14 and 15. The support 2 extends continuously between the two pieces 14 and 15.

The first piece 14 and the second piece 15 can be made of flexible plastic material such as rubber, for example. Each of the pieces 14 and 15 is made in one single piece of material, for example by moulding.

As illustrated in FIGS. 2 and 3, the coaxial cable connector 13 is a connector having an elbow shape. The connector 13 comprises a body 16, a connecting socket 17 of a coaxial cable and contact pads 18 to 21.

The connecting socket 17 comprises a tubular part 22 adapted for receiving one end of a coaxial cable in a connection direction X, parallel to the plane of the support 2. The tubular part 22 has a threaded external surface for screwing the end of the cable onto the connecting socket 17.

The contact pads 18 to 21 extend projecting from the body 16 in a direction Y, substantially perpendicular to the connecting direction X of the coaxial cable. In the example illustrated in FIG. 2, there are four contact pads 18 to 21.

As illustrated in FIGS. 4A to 4D, the first piece 14 (or interface piece) is designed to encapsulate the connector 13. For this reason, the first piece 14 comprises a cavity 23 adapted for housing the connector 13. Also, the first piece 14 comprises a first opening 24 through which the connecting socket 17 of the connector 13 extends to connect the coaxial cable and a second opening 25 through which contact pads 18 to 21 extend to come into contact with tracks of the antenna.

The first opening 24 has a circular shape for passage of the tubular part 22 through the first opening 24.

The first piece 14 further comprises a substantially planar part 26 (or first plate) having a first planar face 27 intended to come into contact with the first face 5 of the support 2, and a bulging part 28 extending projecting from the planar part 26 and enclosing the cavity 23. The bulging part 28 has a curved external surface 29.

The second opening 25 is formed in the first face 27. The second opening 25 has a substantially rectangular form.

The second opening 25 is configured such that, during assembly of the connecting device 4, the connector 13 can be inserted into the cavity 23 via the second opening 25.

Also, the first piece 14 comprises a plurality of attachment pins 30 to 36 extending projecting from the first face 27.

As illustrated in FIGS. 4A to 4C, the second piece 15 (or counter-piece) comprises a planar part 37 (or second plate) having a second planar face 38 intended to come into contact with the second face 6 of the support 2. The planar part 37 of the second piece 15 has dimensions substantially identical to the dimensions of the planar part 26 of the first piece 14.

The second piece 15 further comprises fastening holes 40 to 46 formed through the planar part 37.

Each attachment pin 30 to 36 of the first piece 14 is suitable for being inserted into a corresponding fastening hole 40 to 46 of the second piece 15 to fix the first piece 14 and the second piece 15 together.

The connecting device 4 is mounted on the support 2 as follows.

The connector 13 is first inserted into the cavity 23 of the first piece 14 via the second opening 25. For this reason, the connecting socket 17 is introduced into the cavity 23 via the second opening 25 then is passed through the first opening 24 so as to project out from the first piece 14.

Once the connector 13 is inserted into the first piece 14, the contact pads 18 to 21 of the connector 13 project out from the first piece 14 through the second opening 25 to the side of the first face 27.

The first piece 14 is then positioned against the first face 5 of the support 2. More precisely, the first face 27 of the first piece 14 is in contact with the first face 5 of the support 2.

The first piece 14 is positioned such that each contact pad 18 to 21 is in contact with one end 9 to 12 of a conductive track 7, 8. More precisely, each contact pad 18, 19, 20 and 21 is in contact with the ends 9, 10, 11 and 12 respectively.

Similarly, the second piece 15 is positioned in contact with the second face 6 of the support 2. More precisely, the second face 38 of the second piece 15 is in contact with the second face 6 of the support 2.

So the support 2 extends continuously between the two pieces 14 and 15 of the device without being deformed.

Next, the first piece 14 and the second piece 15 are pressed towards each other such that the attachment pins 30 to 36 of the first piece 14 pass through the support 2 and are plugged into the fastening holes 40 to 46 of the second piece 15.

The attachment pins 30 to 36 can be inserted by force into the fastening holes 40 to 46 so as to fix the first piece 14 and the second piece 15 together.

Alternatively, the attachment pins 30 to 36 can be crimped in the fastening holes 40 to 46, once the attachment pins 30 to 36 are inserted in the fastening holes 40 to 46.

Once the pieces 14 and 15 are fixed to each other, the support 2 is clamped between the first piece 14 and the second piece 15, maintaining electrical contact between the contact pads 18 to 21 and the conductive tracks 7 and 8.

For connecting the circuit 3 to electronic communication equipment, a coaxial connecting cable can be connected to the socket 17.

As the support 2 is clamped between the planar faces 27 and 38 of the two pieces 14 and 15, the proposed connecting device 4 limits the risk of tearing the support 2 in case of tension applied on the coaxial cable.

Also, due to the curved shape of the bulging part 28, the first piece 14 limits discomfort created by the presence of the connecting device projecting from the support 2.

Finally, the first piece 14 protects the connector 13.

The invention claimed is:

1. A connecting device (4) of a radiofrequency circuit or component (3) printed on a flexible support (2) to a coaxial cable, comprising:

a coaxial cable connector (13) comprising a body (16), a connecting socket (17) for a coaxial cable adapted for receiving one end of a coaxial cable in a connection direction (X), and contact pads (18-21) suitable for coming into contact with tracks (7, 8) of the radiofrequency circuit or component (3), the contact pads (18-21) extending projecting from the body (16) in a direction (Y), substantially perpendicular to the connecting direction (X) of the coaxial cable, a first piece (14) suitable for being arranged against a first face (5) of the support (2) on which the circuit or the component (3) is printed, the first piece (14) comprising a cavity (23) suitable for housing the coaxial cable connector (13), a first opening (24) through which the connecting socket (17) of the connector (13) extends and a second opening (25) through which the contact pads (18-21) of the connector (13) extend, a second piece (15) suitable for being arranged against a second face (6) of the support (2), opposite the first face, and wherein the first piece (14) and/or the second piece (15) comprises fixing means (30-36, 40-46) for fixing the first piece (14) and the second piece (15) together, the flexible support (2) being clamped between the first piece (14) and the second piece (15) so as to maintain electrical contact between the connector (13) and the circuit or component (3).

2. The device according to claim 1, wherein the first piece (14) has a first planar face (27) arranged in contact with the first face (5) of the support (2) when the first piece (14) is arranged against the first face (5) of the support (2).

3. The device according to claim 1, wherein the second piece (15) has a second planar face (38) arranged in contact with the second face (6) of the support (2) when the second piece (15) is arranged against the second face (6) of the support (2).

4. The device according to claim 1, wherein the fixing means (30-36, 40-46) comprise fastening holes (40-46) formed in one (15) of the pieces and attachment pins (30-36) formed in the other (14) of the pieces and suitable for being inserted into the fastening holes (40-46) for fixing the first piece (14) and the second piece (15) together.

5. The device according to claim 4, wherein the attachment pins (30-36) extend through the flexible support (2) when the first piece (14) and the second piece (15) are fixed together, the flexible support (2) being clamped between the first piece (14) and the second piece (15).

6. The device according to claim 1, wherein the connecting socket (17) for a coaxial cable is adapted for connecting the coaxial cable in a connection direction (X) substantially parallel to the first face (5) of the support (2).

7. The device according to claim 6, wherein the cable connector (13) comprises a threaded surface for screwing the coaxial cable onto the connector (13).

8. The device according to claim 1, wherein the contact pads (18-21) of the connector (13) extend in a direction (Y) substantially perpendicular to the first face (5) of the support (2).

9. The device according to claim 2, wherein the contact pads (18-21) of the connector (13) extend in a direction (Y) substantially perpendicular to the first face (5) of the support (2).

10. The device according to claim 3, wherein the contact pads (18-21) of the connector (13) extend in a direction (Y) substantially perpendicular to the first face (5) of the support (2).

11. The device according to claim 4, wherein the contact pads (18-21) of the connector (13) extend in a direction (Y) substantially perpendicular to the first face (5) of the support (2).

12. The device according to claim 5, wherein the contact pads (18-21) of the connector (13) extend in a direction (Y) substantially perpendicular to the first face (5) of the support (2).

13. The device according to claim 6, wherein the contact pads (18-21) of the connector (13) extend in a direction (Y) substantially perpendicular to the first face (5) of the support (2).

14. The device according to claim 7, wherein the contact pads (18-21) of the connector (13) extend in a direction (Y) substantially perpendicular to the first face (5) of the support (2).

15. The device according to claim 1, wherein the first piece (14) comprises a substantially planar part (26) suitable for coming into contact with the first face (5) of the support (2) and a bulging part (28) enclosing the cavity (23) and extending projecting from the planar part (26), the bulging part (28) having a curved external surface (29).

* * * * *